US007481676B2

(12) United States Patent
Walter et al.

(10) Patent No.: US 7,481,676 B2
(45) Date of Patent: Jan. 27, 2009

(54) ELECTRICAL CONNECTOR WITH ESD PROTECTION

(75) Inventors: Richard Paul Walter, Elizabethtown, PA (US); Brent David Yohn, Newport, PA (US); John Anthony Fulponi, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/512,776

(22) Filed: Aug. 30, 2006

(65) Prior Publication Data

US 2008/0057758 A1 Mar. 6, 2008

(51) Int. Cl.
*H01R 13/648* (2006.01)

(52) U.S. Cl. ..... 439/607; 439/609

(58) Field of Classification Search ..... 439/95, 439/271, 556, 607, 609, 701, 931, 939; 361/818
See application file for complete search history.

(56) References Cited

U.S. PATENT DOCUMENTS 3,977,750 A * 8/1976 Glover et al. ..... 439/320
4,386,814 A * 6/1983 Asick ..... 439/607
4,412,715 A * 11/1983 Bogese, II ..... 439/425
4,516,815 A * 5/1985 Venable et al. ..... 439/95
4,544,227 A * 10/1985 Hirose ..... 439/607
4,655,532 A * 4/1987 Hillis et al. ..... 439/607
4,659,163 A * 4/1987 Althouse et al. ..... 439/608
4,812,137 A * 3/1989 Wilson et al. ..... 439/607
4,938,718 A * 7/1990 Guendel ..... 439/680
4,990,094 A * 2/1991 Chandler et al. ..... 439/108
5,052,948 A * 10/1991 Hyzin ..... 439/607
5,228,871 A * 7/1993 Goodman ..... 439/607
5,605,477 A * 2/1997 Wu et al. ..... 439/620.24
6,206,725 B1 3/2001 Wu
6,244,886 B1 * 6/2001 Strang et al. ..... 439/271
6,736,673 B1 5/2004 Simmons et al.
6,776,621 B1 * 8/2004 Dye ..... 439/63
6,926,539 B2 * 8/2005 Zaderej et al. ..... 439/74
6,953,357 B2 * 10/2005 Fukushima et al. ..... 439/271
7,150,648 B1 * 12/2006 Hall et al. ..... 439/581
2005/0009409 A1 1/2005 Chen
2005/0122694 A1 6/2005 Kane

FOREIGN PATENT DOCUMENTS

WO WO 95/35017 12/1995

OTHER PUBLICATIONS

International Search Report PCT/US2007/018819;dated Jun. 2, 2008.

* cited by examiner

*Primary Examiner*—Thanh-Tam T Le

(57) ABSTRACT

An electrical connector assembly includes a conductive shell and a connector having a dielectric housing disposed within the shell. The housing includes a conductive outer surface. A conductive member is disposed between the shell and the housing. The conductive member and the shell cooperate to provide a ground path from the conductive outer surface of the housing. The conductive outer surface of the connector housing comprises a conductive coating applied to the outer surface of the housing. The conductive member includes a plurality of flexible tabs that electrically engage the conductive outer surface of the housing.

18 Claims, 6 Drawing Sheets

ELECTRICAL CONNECTOR WITH ESD PROTECTION

BACKGROUND OF THE INVENTION

The invention relates generally to electrical connectors, and more particularly, to a connector having enhanced electrostatic discharge (ESD) protection.

When connectors are being mated, opposite charges at the connector interface may result in an electrostatic discharge (ESD) between the two connectors. In fact, electrostatic discharges can be generated simply by a person approaching or touching the connector interface or touching the terminal contacts. Generally, very little current is associated with an electrostatic discharge; however, the voltage can be high enough to damage or destroy certain types of electrical devices such as semiconductor devices. Consequently, when the connector contacts or terminals are electrically associated with such devices on a circuit board, the electrostatic discharge may damage or destroy the electrical devices on the circuit board.

In order to alleviate the electrostatic discharge problem, some electrical connectors include features to provide ESD protection. In at least some connectors, ESD protection is provided with a shield in the form of a plate, bar, or the like located proximate the connector interface and connected to ground on or proximate the connector. Typically, provision is made in the connector housing for mounting the ESD shield and an ESD pathway is provided to ground the shield. However, the provision of such ESD shields may not provide adequate assurance against damage from ESD in certain applications such as line replaceable units or line replaceable connector systems that may be used in aerospace and defense systems. Additionally, providing such ESD shields may be difficult or impossible due to size or other constraints.

A need remains for a connector that provides more robust ESD protection in a cost effective manner.

BRIEF DESCRIPTION OF THE INVENTION

In one aspect, an electrical connector assembly is provided. The assembly includes a conductive shell and a connector having a dielectric housing disposed within the shell. The housing includes a conductive outer surface. A conductive member is disposed between the shell and the housing. The conductive member and the shell cooperate to provide a ground path from the conductive outer surface of the housing.

Optionally, the conductive outer surface of the connector housing comprises a conductive coating applied to the outer surface of the housing. The conductive member includes at least one flexible tab that electrically engages the conductive outer surface of the housing. The conductive member includes a retention tab and the shell includes a ledge engaged by the retention tab to retain the conductive member in the shell. A seal is provided on an outer periphery of the shell and an EMI shield is provided on an outer periphery of the shell. The connector is mounted on a circuit board having a ground plane and the shell is electrically connected the ground plane.

In another aspect, an electrical connector assembly is provided that includes a conductive shell having a connector compartment and an interior wall. A connector having a dielectric housing is disposed within the connector compartment of the shell. The housing includes a conductive outer surface. A conductive member is attached to the interior wall and is disposed between the shell and the housing. The conductive member and the shell cooperate to provide a ground path from the conductive outer surface of the housing.

DETAILED DESCRIPTION OF THE INVENTION

Figure 1:
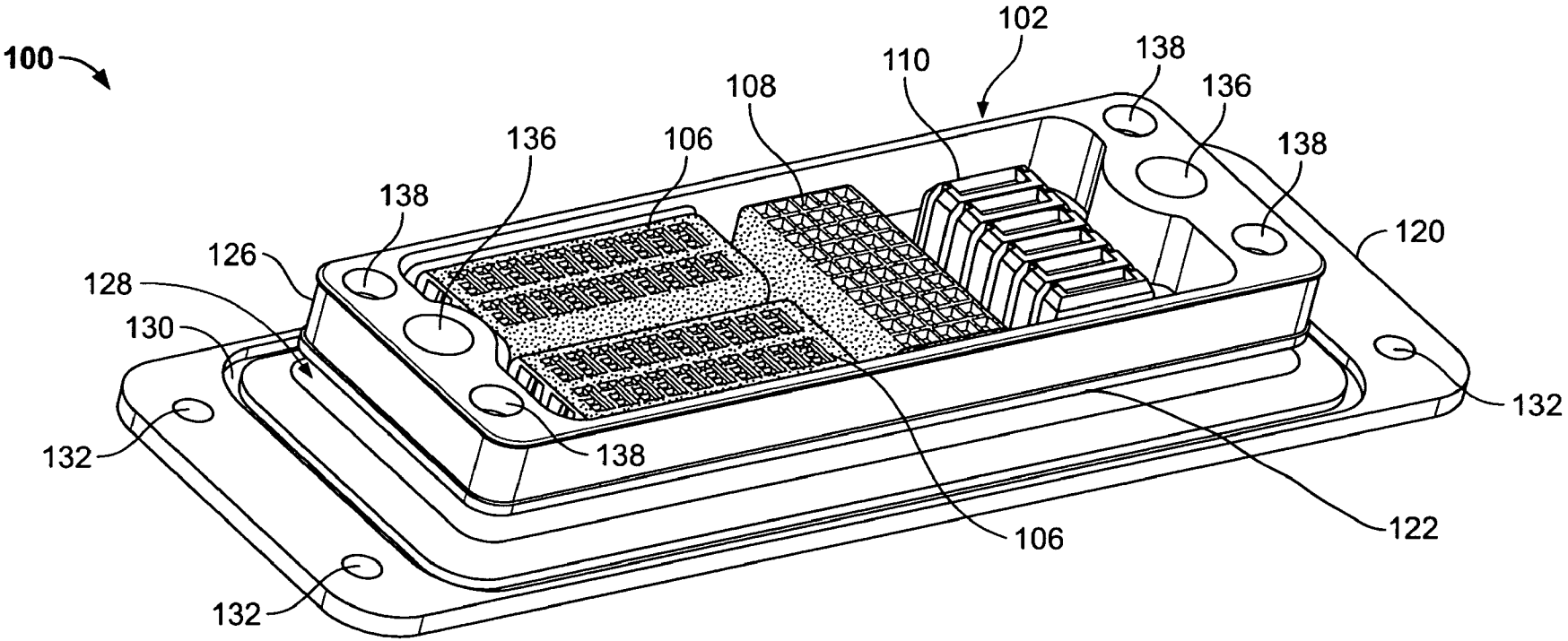
FIG. 1 is a perspective view of a connector assembly formed in accordance with an exemplary embodiment of the present invention.

FIG. 1 illustrates a perspective view of a connector assembly 100 formed in accordance with an exemplary embodiment of the present invention. The assembly 100 includes a shell 102 within which one or more connectors are disposed. In the assembly 100, as illustrated, the shell 102 holds a pair of signal connectors 106, an open pin field module connector 108, and a power connector 110. While the invention will be described in terms of a connector assembly 100 shown, it is to be understood that the following description is for illustrative purposes only and is but one potential application of the inventive concepts herein. It is appreciated that the benefits and advantages of the invention may accrue equally to other types of connector assemblies including other connector combinations.

Figure 2:
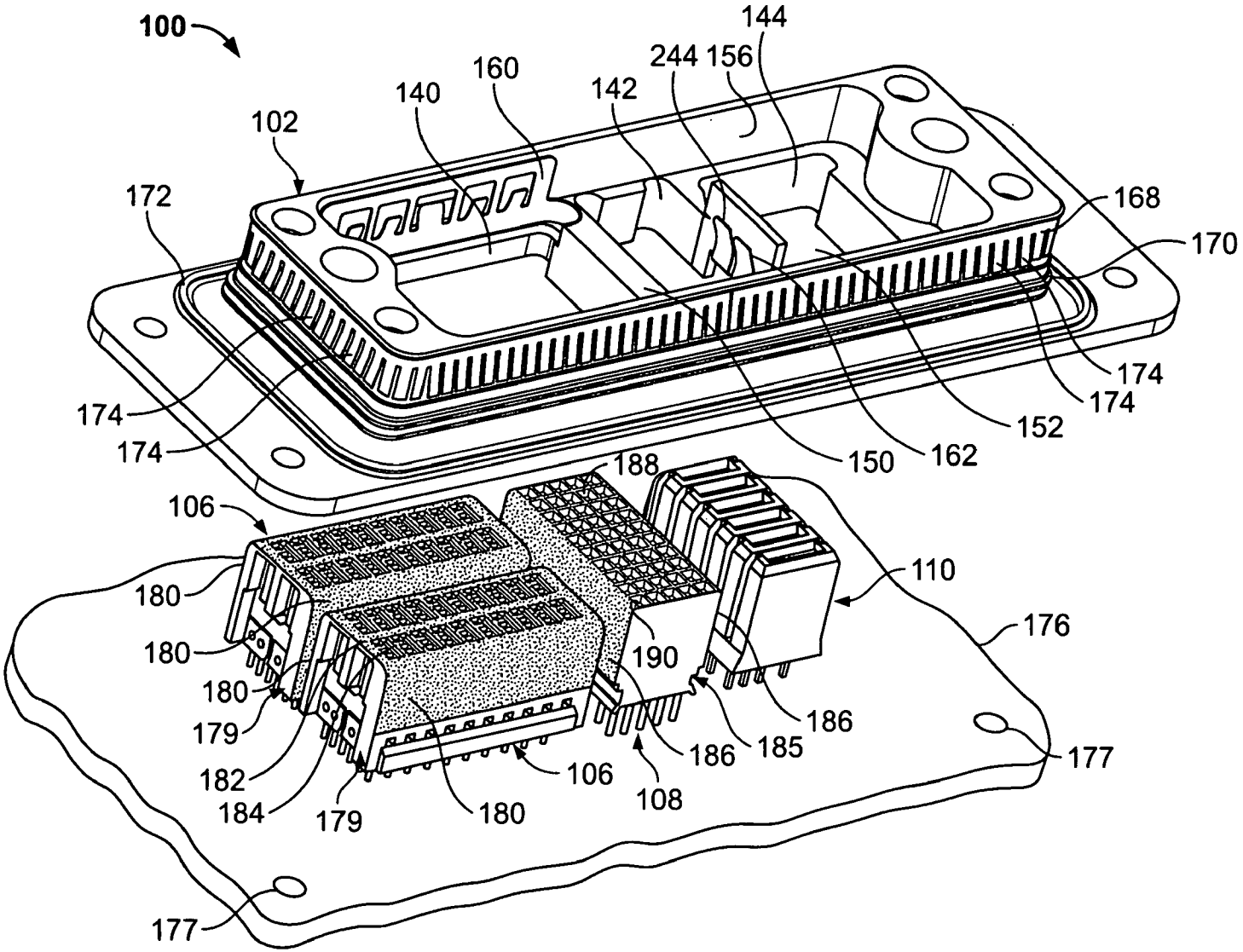
FIG. 2 is a perspective view of the assembly shown in FIG. 1 with the connectors removed from the shell.

The shell 102 is fabricated from a conductive material and includes a base 120 and an outer wall 122. In an exemplary embodiment, the shell 102 is fabricated from a metallic material. An upper channel 126 and a lower channel 128 are formed in the outer wall 122. An additional channel 130 is provided in the upper surface of the base 120. The base 120 is provided with mounting holes 132 that may be used to mount the shell to a panel (not shown) or to a circuit board 176 (FIG. 2). The shell 102 includes guide pin receptacles 136 for receiving guide pins on a mating connector assembly (not shown). Clearance holes 138 are provided to accommodate screws on the mating connector assembly.

FIG. 2 is a perspective view of the connector assembly 100 with the connectors 106, 108, and 110 removed from the shell 102. The shell 102 is compartmentalized with a first compartment 140 receiving the signal connectors 106. A second compartment 142 receives the connector 108, and a third compartment 144 receives the power connector 110. An interior wall 150 separates the first and second compartments 140 and 142, respectively. A second interior wall 152 separates the second and third compartments 142 and 144, respectively. The shell 102 has an inner perimeter wall 156. Conductive members 160 (only one of which is visible in FIG. 2) are mounted on opposite sides of the inner perimeter wall 156 in the first compartment 140. A second conductive member 162 is mounted on the second interior wall 152.

With reference to FIGS. 1 and 2, the shell 102, as shown in FIG. 2 includes a shield 168 installed in the upper channel 126 on the outer wall 122 and a seal 170 installed in the lower channel 128. A seal 172 is installed in the channel 130 on the base 120. The shield 168 is fabricated from a conductive material and is provided for electromagnetic interference (EMI). The shield 168 includes a plurality of flexible fingers 174 that engage an inner surface on the shell of a mating connector assembly (not shown). The seals 170 and 172 are fabricated from a compressible material such as rubber or a number of other such materials that are well known in the art. The seal 170 provides environmental sealing between the shell 102 and a shell of the mating connector assembly.

In the illustrated embodiment, the connectors 106, 108, and 110 are mounted on a circuit board 176 that has mounting holes 177 for mounting the shell 102 to the circuit board 176. The circuit board 176 includes a ground plane, and the shell 102 is electrically connected to the ground plane. In one embodiment, the connectors 106 may carry high speed signals in differential pairs. The connectors 106 include housings 179 having conductive side surfaces 180 and an upper surface 182 that also has conductive areas. The conductive portions of the housing upper surface 182 do not extend into contact apertures 184. Similarly, the connector 108 includes a housing 185 having conductive side surfaces 186 and a conductive upper surface 188 that has conductive areas. And, as with the signal connectors 106, the conductive areas on the housing upper surface 188, the conductive portions of the upper surface 188 do not extend into contact apertures 190.

In alternative embodiments, the shell 102 may be mounted to a panel (not shown) and the connectors 106, 108, and 110 may be attached to cables. Moreover, the connectors 106, 108, and 110 may be disposed in separate shells. The seal 172 provides an environmental seal between the shell 102 and a panel (not shown) when the shell 102 is mounted to the panel.

Figure 3:
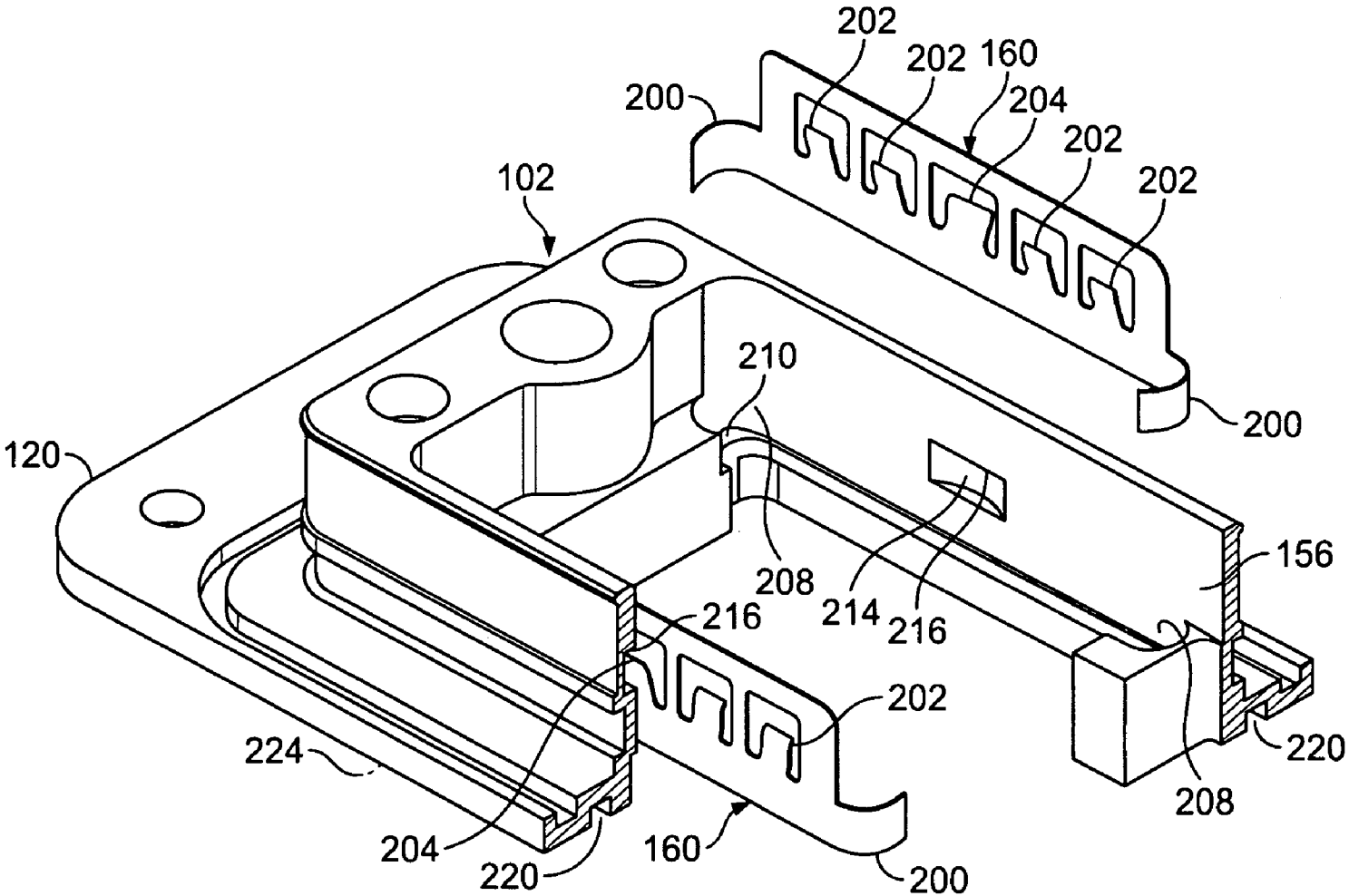
FIG. 3 is a fragmentary view showing the signal connector compartment of the shell and the conductive member shown in FIG. 2.

FIG. 3 illustrates a fragmentary view of the shell 102 showing the signal connector compartment 140 and the conductive member 160. In the illustrated embodiment, the conductive member 160 is a substantially flat member with curved ends 200. The conductive member 160 includes one or more inwardly projecting flexible tabs 202 and at least one outwardly projecting retention tab 204. The shell 102 includes curved interior pockets 208 that are complementary in shape to the curved ends 200. When the conductive member 160 is installed in the shell 102, the curved ends 200 are received in the pockets 208. The curved ends 200 rest on ledges 210 formed in the shell 102. In alternative embodiments, other end configurations are contemplated. For instance, the conductive member 160 may have straight ends, in which case, the shell 102 would be provided with a slits sized to receive the straight ends. A cavity 214 is formed in the inner perimeter wall 156. The cavity 214 includes an upper ledge 216 that is engaged by the retention tab 204 to retain the conductive member 160 in the shell 102. A lower seal channel 220 is formed on a lower side 224 of the shell base 120.

Figure 4:
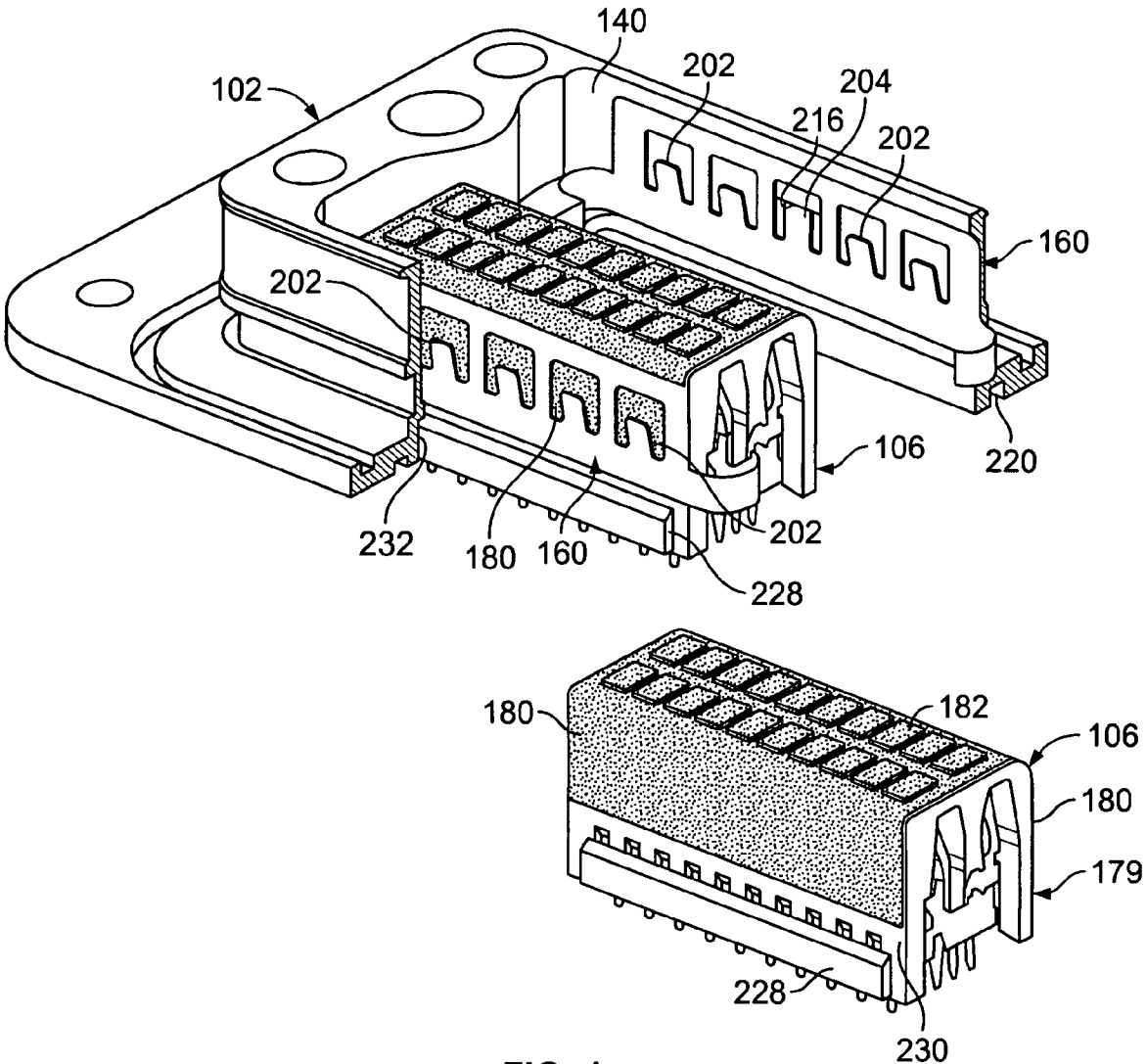
FIG. 4 is a fragmentary view of the signal connector compartment with a connector installed.

FIG. 4 is a fragmentary view of the signal connector compartment with a connector 106 installed. A rail 228 extends along a side 230 of the connector housing 179. When the connectors 106 are installed in the shell 102, the rail 228 is received in a channel 232 along a lower portion of the inner wall 156 in the first compartment 140. The inward tabs 202 of the conductive member 160 engage one of the conductive side surfaces 180 of the connector housing 179. The conductive member 160 and the shell 102 cooperate to provide a conductive path to ground from the conductive side surfaces 180 of the connector housing 179. The conductive portions of the housing upper surface 182 are coextensive with the conductive side surfaces 180. The ground path from the conductive surfaces 180 and 182 minimizes the risk of arching reaching the connector contacts and thus facilitates the prevention of damage to the connectors 106 and other electrical components on the circuit board 176 (FIG. 2) from an electrostatic discharge (ESD) near the connectors 106.

In an exemplary embodiment, the conductive side surfaces 180 and the conductive portions of the upper surface 182 of the housing 179 comprise a conductive ink applied to the outer surfaces of the connectors 106. Suitable inks include Highly Conductive Silver Inks PI-2200 and PI-2600, both of which are commercially available from Dow Corning Corporation. Alternatively, the conductive side surfaces 180 and the conductive portions of the upper surface 182 may comprise other conductive materials such as a conductive tape.

In some embodiments, the conductive member 160 may be attached to or integrally formed with the connector housings 179 and may take such forms as, for example, flexible members or bumps that engage the shell 102. In such embodiments, the conductive members would also include conductive outer surfaces as described above.

Figure 5:
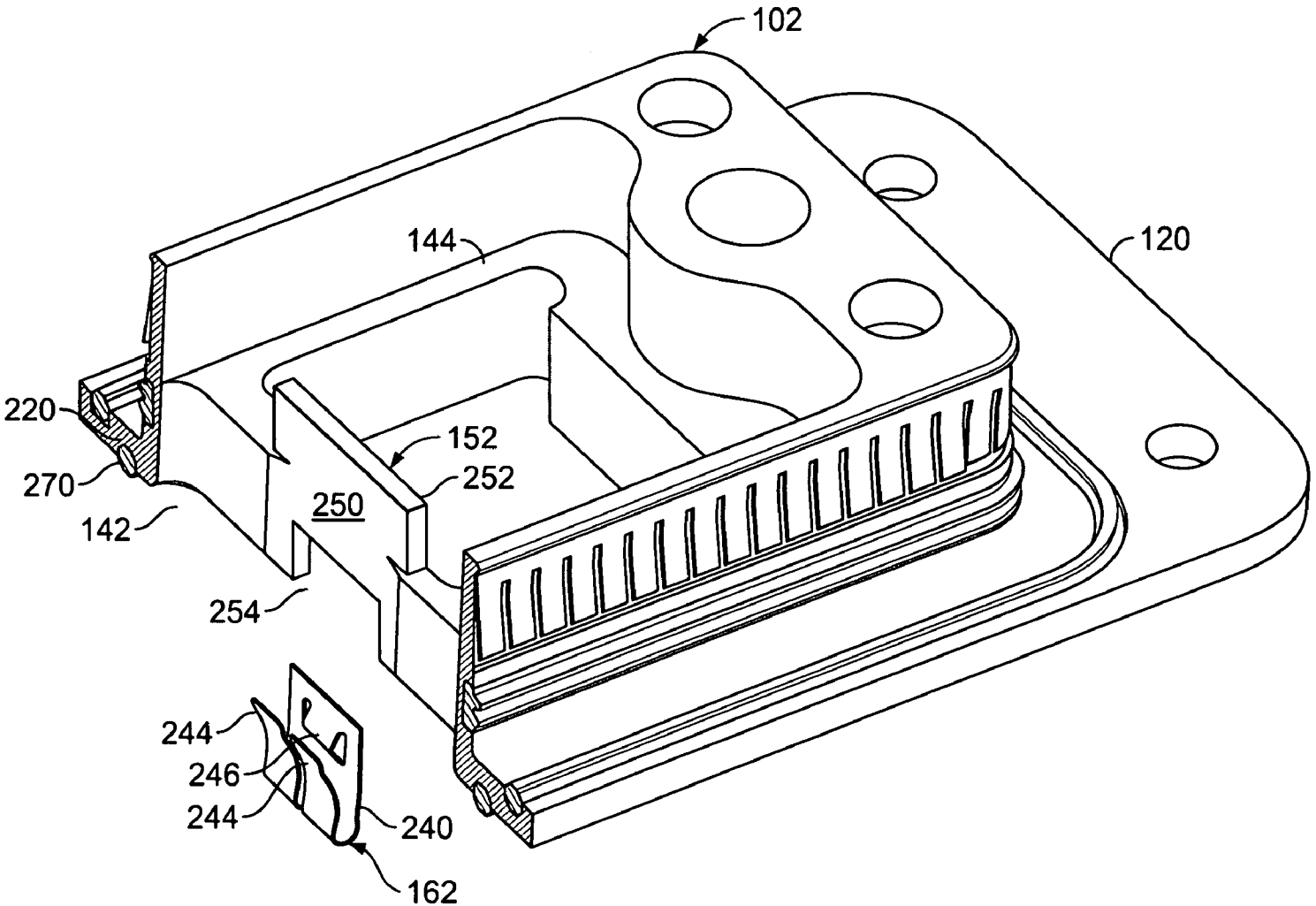
FIG. 5 is a fragmentary view of the shell and the second conductive member shown in FIG. 2 showing the dividing wall between the second and third compartments.
Figure 6:
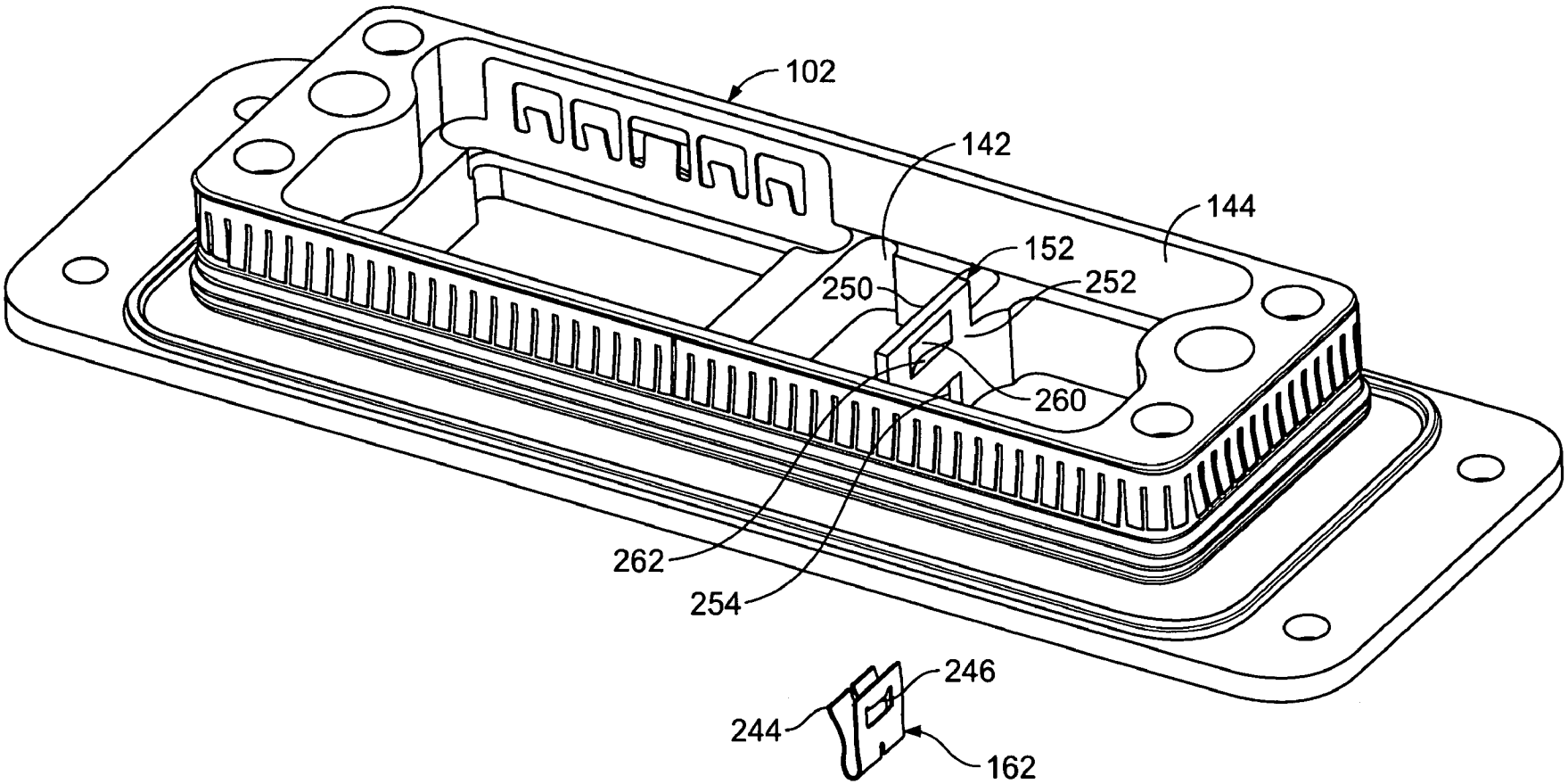
FIG. 6 is a perspective view of the shell shown in FIG. 1 and the conductive member shown in FIG. 5.

FIG. 5 illustrates a fragmentary view of the shell 102 and the second conductive member 162. FIG. 6 is a perspective view of the shell 102 and the conductive member 162. The conductive member 162 illustrates an alternative embodiment of a conductive member. The conductive member 162 is a generally U-shaped member that includes a back wall 240 and one or more flexible tabs 244. The back wall 240 is formed with an inwardly projecting tab 246. The compartment wall 152 includes a first side 250, a second side 252 and a cutout 254. When installed in the shell 102, the conductive member 162 is positioned in the cutout 250 and straddles the compartment wall 152. That is, the back wall 240 of the conductive member 162 lies on the second side 252 of the compartment wall 152 while the flexible tabs 244 lie along the first side 250 of the compartment wall 152 (see FIG. 2). The compartment wall 152 includes a cavity 260 and a ledge 262 formed in the second side 252. When installed in the shell 102, the tab 246 engages the ledge 262 to retain the conductive member 162 in the shell 102, and the flexible fingers project slightly into the second compartment 142.

When the connector 108 (FIG. 2) is installed in the shell 102, the flexible tabs 244 of the conductive member 162 engage one of the conductive side surfaces 186 of the connector housing 185. The conductive member 162 and the shell 102 cooperate to provide a conductive path to ground from the conductive side surfaces 186 of the connector housing 185. As with the connector 106, the conductive portions of the housing upper surface 188 of the connector 108 are coextensive with the conductive side surfaces 186. The ground path from the conductive surfaces 186 and 188 minimizes the risk of arching reaching the connector contacts and thus facilitates the prevention of damage to the connector 108 and other electrical components on the circuit board 176 (FIG. 2) from an electrostatic discharge (ESD) near the connector 108. The conductive surfaces 186 and 188 of the connector housing 185 may comprise a conductive ink or conductive tape as previously described. As shown in FIG. 5, a seal 270 is provided in the channel 220 on the underside 224 of the shell base 120. The seal 270 provides an environmental seal between the shell 102 and the circuit board 176 when the shell 102 is mounted on the circuit board 102.

The embodiments herein described provide a connector assembly with enhanced electrostatic discharge (ESD) protection at a reasonable cost. The connectors are provided with conductive outer surfaces and are disposed within a conductive shell that is electrically connected to ground. Flexible conductive members are positioned between the connectors and the shell so a path to ground is provided from the conductive outer connector surfaces. With the ESD protection provided, the connector assembly is suitable for use in line replaceable units or line replaceable connector systems.

While the invention has been described in terms of various specific embodiments, those skilled in the art will recognize that the invention can be practiced with modification within the spirit and scope of the claims.

What is claimed is:

1. An electrical connector assembly comprising:

a conductive shell having a perimeter wall defining a compartment;

a connector having a dielectric housing disposed within said compartment of said shell, said housing including an outer surface including side surfaces and a mating surface configured to face a mating connector mated with said connector, and said housing including a conductive coating applied to said mating surface of said outer surface to form a conductive outer surface; and a conductive member disposed between, and engaging, said shell and said conductive outer surface of said housing, said conductive member and said shell cooperating to provide a ground path from said conductive outer surface of said housing to said shell even when said connector is unmated; wherein said connector is mounted on a circuit board having a ground plane and said shell is electrically connected the ground plane.

2. The electrical connector assembly of claim 1, wherein said conductive coating comprises a conductive ink applied to said outer surface.

3. The electrical connector assembly of claim 1, wherein said conductive member comprises at least one flexible tab that electrically engages said conductive outer surface of said housing.

4. The electrical connector assembly of claim 1, wherein said conductive member includes a retention tab and said shell includes a ledge engaged by said retention tab to retain said conductive member in said shell.

5. The electrical connector assembly of claim 1, wherein said conductive member is integrally formed with said housing.

6. The electrical connector assembly of claim 1, said mating surface having a plurality of contact apertures each containing an individual contact configured to mate with a mating contact of a mating connector, said conductive coating being positioned generally between said individual contact and said mating connector to reduce a risk of arcing proximate said contact aperture.

7. The electrical connector assembly of claim 6, said conductive coating being applied to at least one of said side surfaces, said conductive member engaging said side surface that is coated with said conductive coating.

8. The electrical connector assembly of claim 6, wherein said conductive coating does not extend beyond said mating surface into said contact apertures.

9. The electrical connector assembly of claim 6, wherein said conductive coating comprises a conductive ink applied to said mating surface by a screening process.

10. The electrical connector assembly of claim 1, wherein said conductive coating comprises a conductive tape.

11. An electrical connector assembly comprising:

a conductive shell having a connector compartment and an interior wall;

a connector having a dielectric housing disposed within said connector compartment of said shell, said housing having a mating surface and side surfaces, said housing having a plurality of contact apertures each containing an individual contact that extends to a tip, said contacts being arranged within said contact apertures such that said tips are positioned below said mating surface and said contact apertures being open at said mating surface, said housing including a conductive coating applied to said mating surface proximate to said contact apertures and said conductive coating applied to at least one of said side surfaces, said conductive coating forms a conductive outer surface; and a conductive member engaging said interior wall and said conductive coating, said conductive member and said shell cooperating to provide a ground path from said conductive outer surface of said housing to said shell even when said connector is unmated; wherein said mating surface configured to face a mating connector mated with said connector; and wherein said connector is mounted on a circuit board having a ground plane and said shell is electrically connected the ground plane.

12. The electrical connector assembly of claim 11, wherein said conductive coating comprises a conductive ink applied to said outer surface.

13. The electrical connector assembly of claim 11, wherein said conductive member comprises at least one inwardly projecting tab that electrically engages said conductive outer surface of said housing.

14. The electrical connector assembly of claim 11, wherein said conductive member includes a retention tab and said interior wall includes a ledge engaged by said retention tab to retain said conductive member in said shell.

15. The electrical connector assembly of claim 11, wherein said shell includes a guide pin receptacle configured to receive a guide pin on a mating connector assembly.

16. The electrical connector assembly of claim 11, wherein said shell includes a base configured to be mounted to a panel.

17. The electrical connector assembly of claim 11, wherein said conductive coating does not extend beyond said mating surface into said contact apertures.

18. The electrical connector assembly of claim 11, wherein said conductive coating comprises a conductive tape.

* * * * *